US006302196B1

(12) United States Patent
Haussmann

(10) Patent No.: US 6,302,196 B1
(45) Date of Patent: Oct. 16, 2001

(54) HEAT EXCHANGER AS HEAT EXCHANGER IN HEATING INSTALLATIONS OR ENGINE RADIATOR OF MOTOR VEHICLES

(75) Inventor: Roland Haussmann, Wiesloch (DE)

(73) Assignee: Valeo Klimatechnik GmgH & Co., KG (DE)

( * ) Notice: Subject to any disclaimer, the term of this patent is extended or adjusted under 35 U.S.C. 154(b) by 0 days.

(21) Appl. No.: 09/300,027

(22) Filed: Apr. 27, 1999

(30) Foreign Application Priority Data

Apr. 29, 1998 (DE) ..... 198 19 247

(51) Int. Cl.[7] ..... F28F 9/16; F28F 9/22

(52) U.S. Cl. ..... 165/153; 165/174; 165/175; 165/176

(58) Field of Search ..... 165/153, 173–176

(56) References Cited

U.S. PATENT DOCUMENTS

| | | | | |
|---|---|---|---|---|
| 3,275,070 | * | 9/1966 | Beatenbough | 165/175 X |
| 3,581,814 | * | 6/1971 | Jackson | 165/175 X |
| 3,703,925 | * | 11/1972 | Ireland et al. | 165/175 X |
| 5,195,581 | * | 3/1993 | Puntambekar et al. | 165/173 |
| 5,366,008 | * | 11/1994 | Kadle et al. | 165/173 |
| 5,582,239 | * | 12/1996 | Tsunoda et al. | 165/176 X |
| 5,605,191 | * | 2/1997 | Eto et al. | 165/176 |

FOREIGN PATENT DOCUMENTS

| | | | | |
|---|---|---|---|---|
| 4432972 | * | 4/1995 | (DE) | 165/175 |
| 3-286992 | * | 12/1991 | (JP) | 165/176 |
| 4-278196 | * | 10/1992 | (JP) | 165/175 |
| 1278566 | * | 12/1986 | (SU) | 165/173 |
| 1322070 | * | 7/1987 | (SU) | 165/173 |

* cited by examiner

*Primary Examiner*—Leonard Leo
(74) *Attorney, Agent, or Firm*—Morgan & Finnegan, LLP

(57) ABSTRACT

The invention relates to an at least double-flow flat tube heat exchanger of aluminum for motor vehicles with at least one water case with cap and tube bottom connected in communication with one end of the flat tubes, the multi-flow flat tubes engaging in a soldered or brazed connection with their free ends each slit in the tube bottom, the water case being divided into at least one compartment on the inlet and one compartment on the outlet side by at least one partition arranged at the plane of each of the partitions between adjacent flows of the flat tubes, and the partition of the water case each engaging a groove or a slit in the tube bottom thereby intersecting the free ends of the flat tubes. Accordingly to the invention, it is provided that across the edge of the tube bottom openings formed therein are distributed, which are engaged by tongues formed at the free edge of the cap in a soldered or brazed connection.

8 Claims, 4 Drawing Sheets

HEAT EXCHANGER AS HEAT EXCHANGER IN HEATING INSTALLATIONS OR ENGINE RADIATOR OF MOTOR VEHICLES

BACKGROUND OF THE INVENTION

The invention relates to a heat exchanger in heating installations or an engine radiator of motor vehicles with the features of a double flow row arrangement of parallel flat tubes, which are connected to one another via zig zag fins, at least one water case with a tube bottom and a cap in communication with free ends of the tubes, the flat tubes have a double flow design by a tube partition extending longitudinally and engaging at the free end of the tubes a slit in the tube bottom common to both flows at both sides of the tube partition, the water case is divided into an inlet and an outlet, arranged at the plane of the tube partition, a header partition engages the groove or slit in the tube bottom and a groove in the cap thereby intersecting the free ends of the flat tubes, and the tube bottom or cap and the partition of the water case as well as the flat tubes and zig zag fins arc made of aluminum or an aluminum alloy. Such a heat exchanger is known from EP 0 656 517 A1.

In this known heat exchanger, the partition is soldered or brazed on the one hand into a groove at the cap of the water case and on the other hand into a groove or slit at the tube bottom or tube plate of the water case. It is also possible to alternately or in another group provide grooves at some spots, slits at other spots at the tube bottom to be soldered or brazed with the partition.

From U.S. Pat. No. 5,236,044, on the other hand a heat exchanger, preferably as liquefier or condenser, is known, in which a header which is rounded in order to take up the internal pressure is composed of two shells also rounded which receive a container subdivision between them. In this case, a soldered or brazed engagement with a shell for subdividing the container is effected by an engagement with a groove having at its ground at least one slit adapted to be gripped by a tongue of the container subdivision.

In both mentioned known cases, the interesting and subsequent soldering or brazing of the partition or the container subdivision, respectively, is effected by a direct manipulation at this partition or container subdivision, respectively. This is not only somewhat arduous, but it can also lead to undesired large brazing or soldering gaps in case of a not optimal engagement with the groove or the slit in the sense of the first mentioned publication or the combination of groove and slit in the sense of the second mentioned publication, which involves the risk of a leakage.

BRIEF SUMMARY OF THE INVENTION

The object underlying the invention is to make possible a mounting of the partition between the cap and the tube bottom of the water case of the heat exchanger according to the invention in a simple manner with a secure brazing or soldering.

This object is achieved with a heat exchanger in heating installations or an engine radiator with the a double flow row arrangement of parallel flat tubes, which are connected to one another via zig zag fins, at least one water case with a tube bottom and a cap in communication with free ends of the tubes, the flat tubes have a double flow design by a tube partition extending longitudinally and engaging at the free end of the tubes a slit in the tube bottom common to both flows at both sides of the tube partition, the water case is divided into an inlet and an outlet, arranged at the plane of the tube partition, a header partition engages the groove or slit in the tube bottom and a groove in the cap thereby intersecting the free ends of the flat tubes, and the tube bottom or cap and the partition of the water case as well as the flat tubes and zig zag fins are made of aluminum or an aluminum alloy, wherein across an edge of the tube bottom openings are formed and tongues are provided at the free edge of the cap which are adapted to engage the openings in a soldered or brazed connection.

According to the invention, the fixing of the partition between the tube bottom and the cap is made sure by a separate brazed or soldered engagement at the edge of the water case. Thereby, the size of the brazing or soldering gap of the partition can be adjusted and kept at a minimum with respect to the tube bottom and the cap, thus considerably reducing the risk of a leakage.

From DE 195 15 526 C1, in particular FIG. 10, a heat exchanger specially designed for the conditions of an evaporator of a motor vehicle is known, in which openings formed in the tube bottom are already distributed across the edge of the tube bottom of a header, which openings are engaged by tongues formed at the free edge of a cap of the header in a brazed or soldered connection. A partition extending longitudinally of the header comprises first and second tongues, the first of which grip through slits in the tube bottom and the second of which grip - different from the invention - through slits in the cap. Also different from the invention, here the fixing of the solder gap is effected by upsetting the free ends of the tongues from the outside.

One can here already effect a prefixing before the soldering or brazing of the water case by a form-fit undercut of the groove-and-tongue-like engagement at the periphery of the water case in a mechanically reliable manner. With respect to the manufacture, for this purpose any kind of such a prefixing is possible, possibly an upsetting of the free ends of the tongues projecting through the openings at the periphery of the tube bottom at the cap, possibly by bending them and suchlike.

In this connection, the invention makes it possible to clamp the partition between the cap and the tube bottom utilizing the elasticity of the cap of the water case even with a pretension before the toldering or brazing and to thus achieve the smallest possible soldering or brazing gap.

Assembly of tube bottom and cap during the assembly which is mechanically as easy as possible. In this case, prevents a mutual blocking of tube bottom and cap due to a jackknifing partition by this partition being beforehand at least roughly oriented in the direction of the engagement with a groove in the cap at at least one local spot and then being guided into the final engagement position.

It shows that the fixing at the periphery of the water case often has to be effected only at the two longitudinal sides of the water case and then automatically also results at the front sides thereof.

The invention is not restricted to the clamping and soldering or brazing of the partition, but that in the sense of the second mentioned prepublication it also includes the existence of at least one transverse wall which can then be analogously mounted and soldered or brazed between the tube bottom and the cap.

In case of the peripheral fixing it is possible to work with a groove arrangement which is continued at its ground by local openings of the tube bottom for receiving the tongues provided at the cap.

A configuration which is particularly simple as to the spatial design is possible.

The invention furthermore concerns a particularly convenient method for manufacturing the cap of a water case of a heat exchanger according to the invention. This method is characterized in that the tongues at the cap which later serve for connecting the cap and the tube bottom of the water case at the periphery can be first of all punched out in the plane of a flat material from which the cap can finally be finished by a deep-drawing process, a two-step deep-drawing process in this case.

BRIEF DESCRIPTION OF THE DRAWINGS

The invention will be illustrated more in detail by means of schematic drawings and several embodiments as follows, wherein.

DETAILED DESCRIPTION OF THE INVENTION

Figure 1:
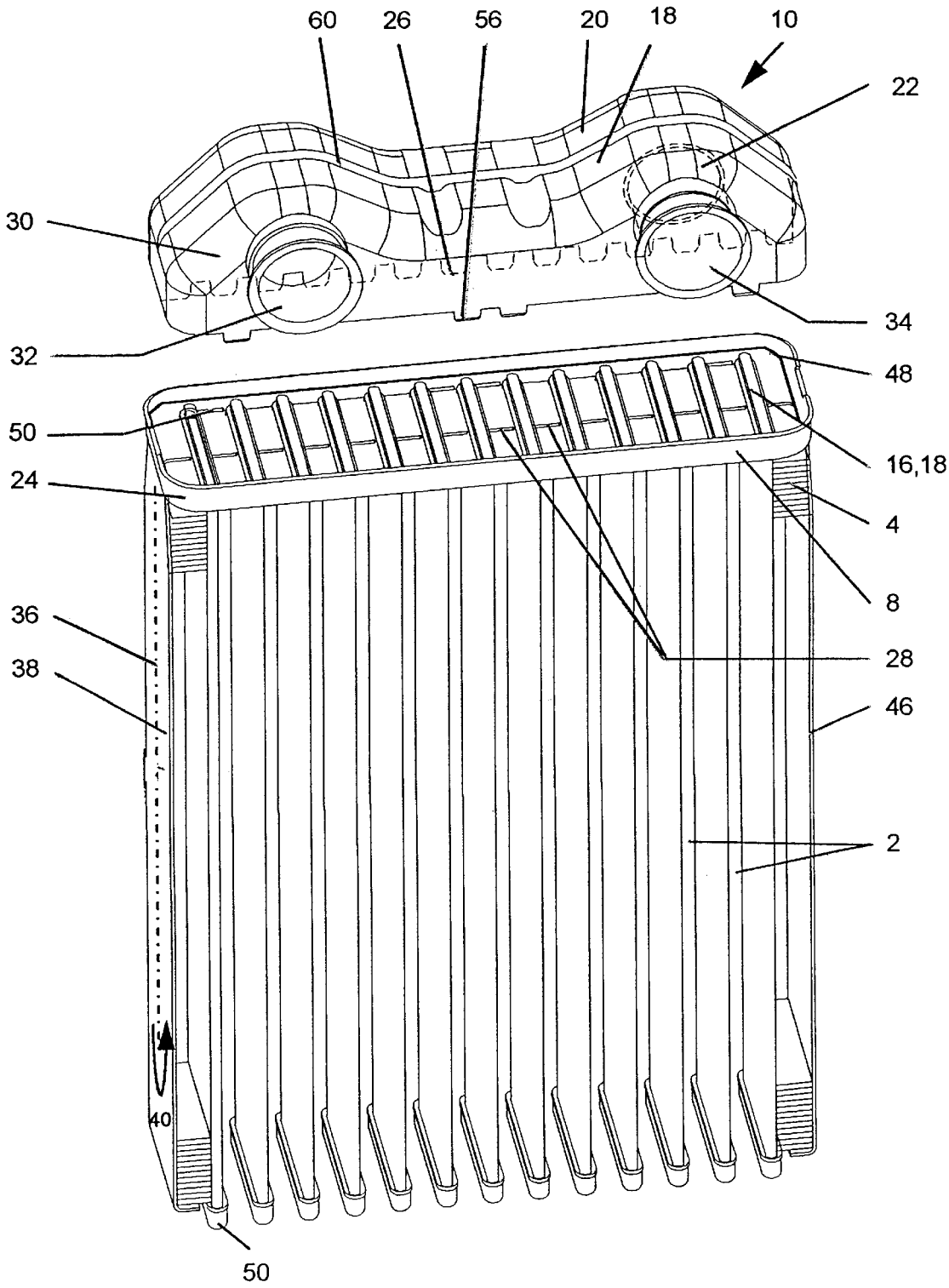
FIG. 1 shows a perspective view of a heat exchanger with the cap of a header being taken off the tube bottom in an exploded view.
Figure 2:
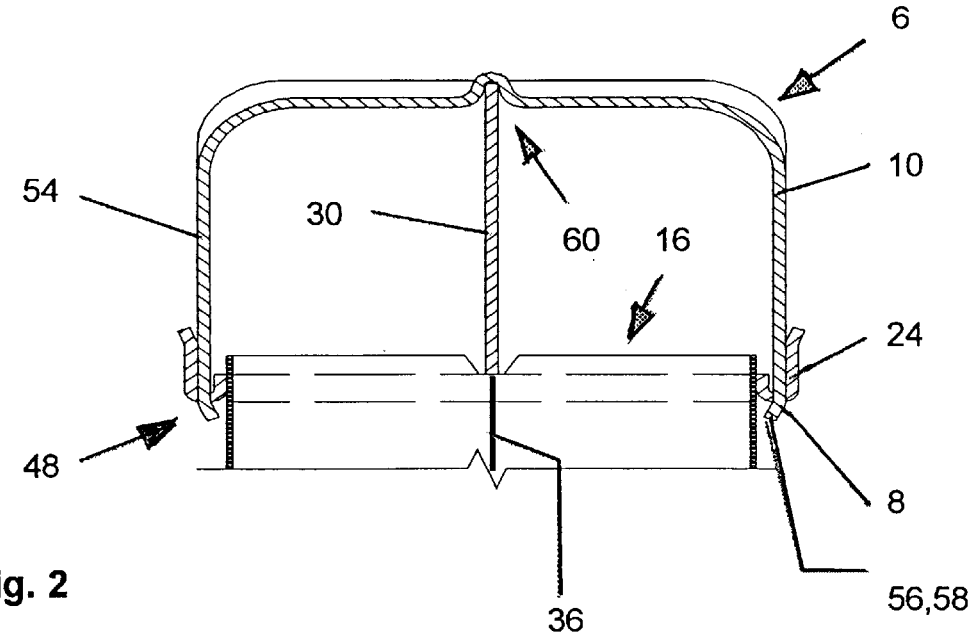
FIG. 2 shows a section transverse to the longitudinal direction of the header through the cap thereof.
Figure 3:
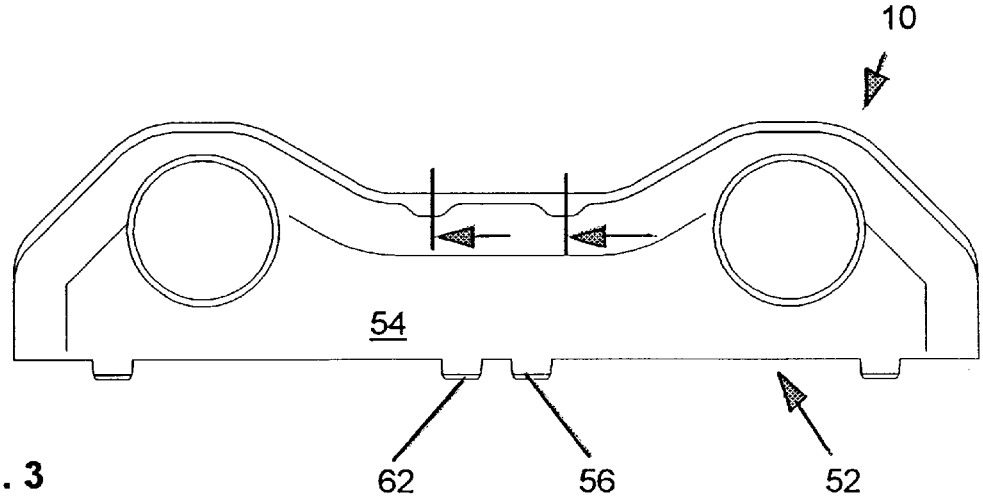
FIG. 3 shows a side view of the cap.

The double-flow heat exchanger according to FIG. 1 comprises a row of parallel flat tubes 2 which are themselves double-flow tubes, the parallel flat sides of which face each other and internest zig zag fins 4 between them, which are furthermore also arranged at the outer flat sides of the outer flat tubes. The zig zag fins 4 and the flat tubes 2 are brazed to one another by a not shown aluminum braze to form a block in the assembled heat exchanger.

At the one ends of the flat tubes 2 arranged at a same level, a water case or header 6 is connected in communication with the flat tubes. The water case consists of a tube bottom or tube plate 8 and a cap 10, which in turn are brazed to one another by aluminum braze. Not only the water case but also the flat tubes, the zig zag fins and the other components to be described in the following are here made of aluminum or an aluminum alloy, such that the complete heat exchanger integrally consists essentially of aluminum.

Figure 4:
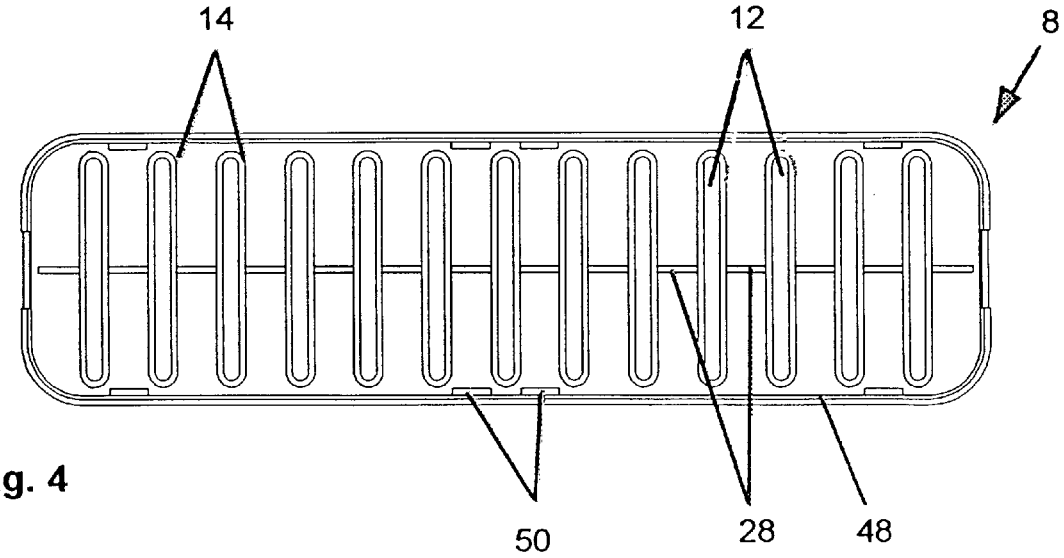
FIG. 4 shows a plan view onto the tube bottom as individual component of the heat exchanger.
Figure 9:
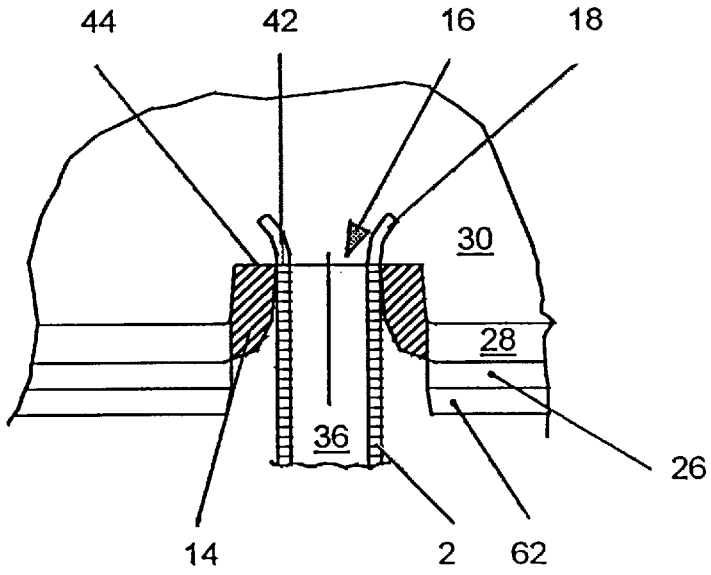
FIG. 9 shows a longitudinal section through the tube-bottom-connection of the header.

In the embodiment, only one water case 6 is provided. The tube bottom thereof comprises parallel slits 12 as represented in FIG. 4, which are each provided with collars 14 oriented into the water case 6. The tube bottom here consists of an aluminum sheet metal with a thickness of e.g. 1.2 mm. This sheet metal is cut at the locations of the slits. The edges of the cuts are then bent up to form the collars 14 as is shown in FIG. 9, The ends of the double-flow flat tubes 2 are inserted into their respective slits 12 far enough for free ends 16 of the flat tubes projecting beyond the collars 14.

The free ends 16 are opened up in the form of a tulip, The openings in the form of a tulip 18 are so far opened up at the two longitudinal sides of the respective slit 12 around the respective collar 14 that they grip around the respective collar to such an extent that an undercutting effect is achieved and a defined expanded solder or braze gap is formed between the bent back opening in the form of a tulip 18 and the collar 14.

Returning to FIG. 1, one can see that the tube bottom 8 has the shape of a box with a surrounding side wall 24. The cap 10 of the water case 6 is placed into the surrounding side wall 24 and brazed with the aluminum braze in a manner not shown. The cap 10 carries a partition 30 which subdivides the water case 6 into two compartments. The one compartment communicates with the inlet 32 and the other one with the outlet 34 of the water as internal heat exchanger fluid.

The flat tubes 2 themselves are provided with a partition 36 at their center which each is arranged at the same level or plane as the partition 30 in the water case. The partitions 36 subdivide the respective flat tube 2 into two parallel ducts 38, in which the internal heat exchanger fluid flows in a flow reverse to the ambient air. Due to this arrangement in a reverse flow the flat tubes 2 are doubleflow flat tubes. The deflection of the flow at the ends of the flat tubes facing away from the water case 6 is effected by the fact that at that location the two ducts and thus the adjacent flows communicate without any throttling. In other words, in this connection region 40 the partition 36 is left away over such a length that the cross-section of the one duct 38 passes over into that of the other duct 38 without any throttling.

The other ends of the flat tubes 2 facing away from the water case 6 are closed by end caps 50.

A side plate 46 each laterally joins the outer zig zag fins 4, which in turn extends parallel to the flat tubes 2.

In accordance with the exploded representation in FIG. 1, the cap 10 has an upper side which is drawn in into the direction towards the bottom in the central portion of its longitudinal extension and from the drawn-in region arches to the top towards the two end sides of the cap in order to obtain there an adaption each to the inner diameter of the inlet 32 and the outlet 34. The outlet 34 directly communicates with the outlet chamber 18, which is separated from the inlet chamber 20 by the longitudinal partition 30 in the cap. For this purpose, the inlet 32 communicates with the inlet chamber 20 via an extension pipe 22 through the longitudinal partition 30.

The longitudinal partition 30 in turn has tongue-like extensions 26 at its edge adjacent to the tube bottom 8, which grip through slits 28 in the tube bottom and externally behind the tube bottom in a form-fit manner, e.g by beading, calking and suchlike. In the final state, the slits are furthermore closed by solder or braze. In this case, the slits 28 extend each into a central region between the collars 14 for receiving the free ends 16 of the flat tubes 2.

According to FIG. 9, in this case the free ends 16 of the flat tubes 2 engage the collars 14 such that the free edge 42 of the flat tube 2 flushes with the free edge 44 of the collar 14.

Furthermore, at the edge 48 of the tube bottom essentially arranged in the extension plane of the tube bottom 8, from which edge at the outside the side walls 24 are bent around, openings 50 are distributed, in which tongues 56 formed at the free edge 52 of the side wall 54 of the cap 10 engage and are soldered or brazed after the mounting. The tongues 56 here grip through the openings 50 comprising protruding ends 58 at the side of the tube bottom 8 opposite too the cap 10, which grip behind the tube bottom 8. As in case of the tongues 26, here a beading, upsetting or a similar after-treatment of the protruding ends 58 can be effected in order to achieve the form-fit gripping behind which is subsequently also soldered or brazed.

At the internal face of the upper side of the cap 10 having the mentioned profile, a longitudinal crimp or bead projecting to the outside is formed, which forms an engagement groove 60 for the partition 30 at the internal side of the cap 10, which in turn engages the slits 28 in the tube bottom. The mounting in this case is effected in a manner such that first of all the partition 30 is inserted into the slits 28 in the tube bottom 8 and then the cap 10 with the tongues 56 is premounted utilizing an elastic or nearly elastic deformability of the cap 10, such that then during the soldering or brazing only a minimal solder or braze gap exists.

This premounting is further facilitated by the following features:

First of all, the tongues 56 have introducing bevels 62 tapering into the direction towards the free end of the tongues. Complementary to this, the openings 50, too, comprise introducing bevels 64.

Figure 5:
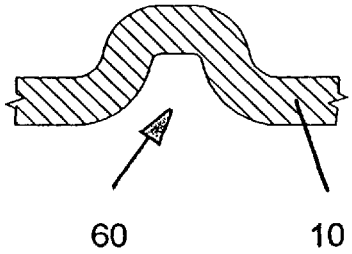
FIG. 5 shows a partial section along the line C in FIG. 3 in an enlarged view.
Figure 5A:
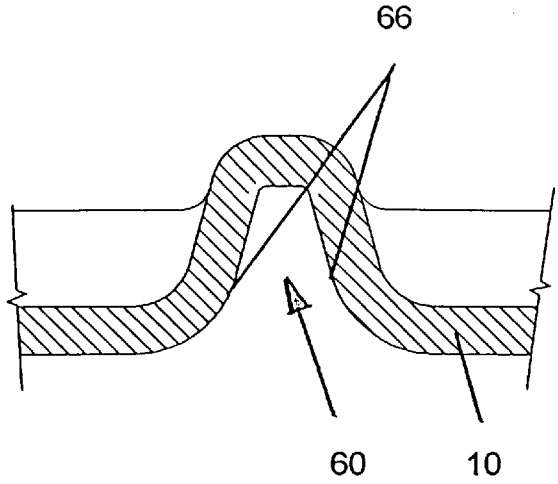
FIG. 5*a* shows a partial section along the line A in FIG. 3 in an enlarged representation.

As can be further seen by comparing the different cross-sections of the engagement groove 60 at the cap in the two sectional planes A and C staggered in the longitudinal direction according to FIGS. 5*a* and 5, in the local region of the sectional plane A according to FIG. 5*a*, the engagement groove 60 at the cap 10 is extended towards the tube bottom at the same time deforming the region of the cap 10 surrounding the groove 60 and forms a funnel-shaped expanded introducing bevel 66 for composing the cap 10 on the one hand and the already premounted combination of tube bottom 8 and partition 30 on the other hand.

As can be seen from FIG. 4, the tongues 56 at the cap 10 and the openings 50 at the tube bottom 8 are only arranged at the two longitudinal sides of the water case.

There are headers or water cases 6, respectively, which are not simply divided by a partition 30 extending longitudinally of the water case, but which furthermore comprise at least one transverse wall which then reasonably consists of aluminum or an aluminum alloy, as does the partition 30, and is in most cases designed integrally with the partition 30 or at least coherently by attachment. Such a transverse wall or several thereof are necessary if the header comprises at least one further outer connection and simultaneously either the same internal heat exchange fluid or a combination of internal heat exchange fluids are supplied to or let out of the same water case. The manner of engagement of such a transverse wall with the cap 10 and the tube bottom 8 can be effected in the same way as was already described with respect to the partition 30 extending longitudinally.

Figure 6:
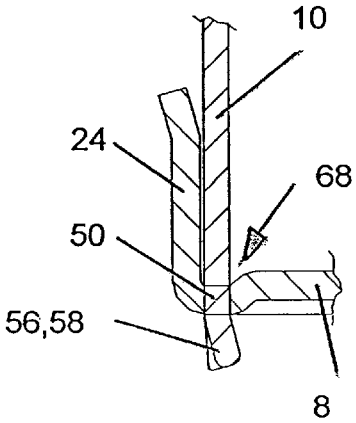
FIGS. 6 and 7 show a section and a spatial representation of a first type of a tongue connection between cap and tube bottom of the header.
Figure 7:
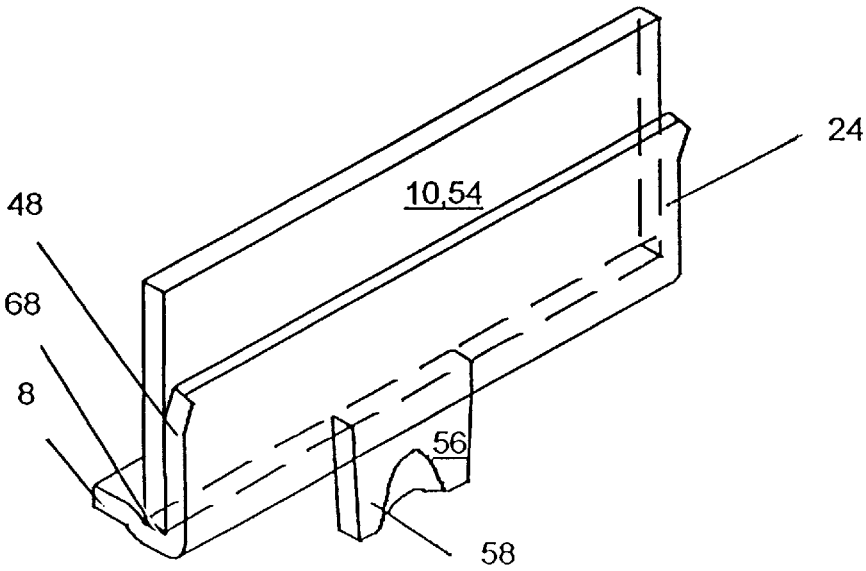

As a particularity it is provided that the openings 50 of the tube bottom 8, which are engaged by the tongues 56 at the cap 10, are according to FIGS. 6 and 7 formed at the ground of a groove 68 surrounding the tube bottom 8, which is engaged by the free edge 52 of the cap.

Figure 6A:
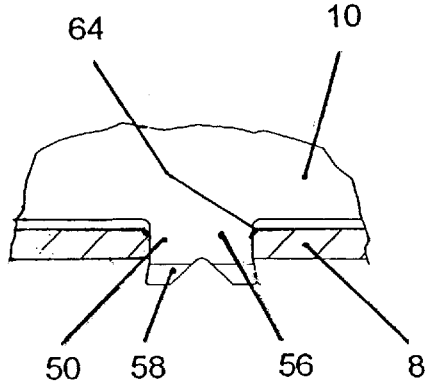
FIG. 6*a* shows a section perpendicular to the sectional plane of FIG. 6 and a spatial representation of a second type of a tongue connection.

Finally, by comparing FIGS. 6 and 7 on the one hand and FIG. 6*a* on the other hand, one can recognize different preferred types of undercuts of the protruding ends 58 of the tongues 56 under the tube bottom 8. In case of FIGS. 6 and 7, however, a calking into the extension direction of the tube bottom 8 is effected from the side in a central zone of the protruding end 58, while according to FIG. 6*a* the wedge is put against the axial direction of the tongue 56 in a central zone of the protruding end 58 and upsets it such that it opens up in the form of a tulip.

Figure 8:
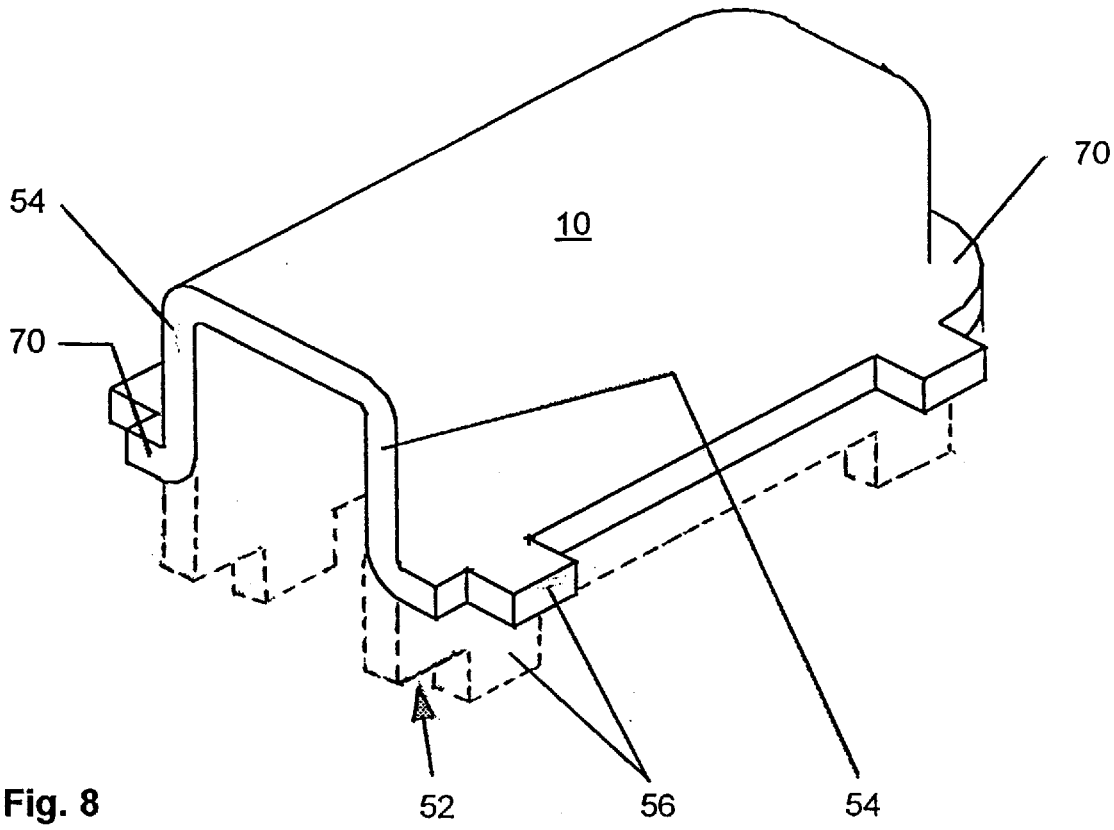
FIG. 8 shows a perspective and sectional schematic drawing of the cap of the header with a representation of two manufacturing steps; end

By means of FIG. 8, finally a preferred method for manufacturing the cap 10 of the water case 6 with the tongues 56 is described.

The shape of the cap 10 represented in a full line is achieved in a first central deep-drawing process in which at the periphery of the region already deformed to form a cap arch a flange-like flat region 70 remains from which the tongues 56 first of all stand off in the flange plane and can thus be cut in the direction of this first deep-drawing process in the punching direction.

After this punching, in a second deep-drawing process the spatial design of the cap 10 only represented in a dash-line in FIG. 8 is achieved, which is described in the preceding figures and in which the tongues 56 are then oriented in alignment with the side wall 54 of the cap.

What is claimed is:

1. A double-flow heat exchanger comprising:

a plurality of flat tubes, each of the flat tubes having a tube partition to divide the flat tube into two parallel ducts;

a plurality of zig zag fins, each of the zig zag fins disposed between a pair of the flat tubes; and at least one water case with a tube bottom and a cap connected in communication with an end of the flat tubes, wherein the water case is divided into an inlet compartment and an outlet compartment by a header partition arranged at a plane defined by each of the tube partitions, the header partition engaging the tube bottom along a first edge and engaging a groove in the cap along a second edge, wherein the tube bottom includes a plurality of openings adapted to be engaged by a plurality of tongues provided at a free edge of the cap, and wherein the tongues of the cap protrude through the openings of the tube bottom and grip the tube bottom at a side opposite to the cap.

2. A heat exchanger according to claim 1, wherein the tube bottom further includes at least one slit, and wherein the header partition further comprises at least one extension adapted to extend through the slit of the tube bottom, and wherein the header partition is clamped between the groove in the cap and the slit in the tube bottom, the header partition being prestressed at least before the connection.

3. A heat exchanger according to claim 1, wherein at least some of the tongues further comprise a tapered bevel at a free end of the tongues.

4. A heat exchanger according to claim 1, wherein the groove in the cap receiving the header partition includes in at least one local region an extension towards the tube bottom with a funnel-like expansion.

5. A heat exchanger according to claim 1, wherein the tongues of the cap and the openings of the tube bottom are arranged along a pair of longitudinal sides of the water case.

6. A heat exchanger according to claim 1, wherein the the header partition is adapted to engage grooves or slits of the tube bottom.

7. A heat exchanger according to claim 1, wherein the tube bottom comprises a surrounding groove adapted to engage the free edge of the cap, and the openings of the tube bottom are formed at a bottom of the surrounding groove.

8. A heat exchanger according to claim 1, wherein a slit of the tube bottom is engaged by a one of the flat tubes, and is designed as a collar pointing into the water case, wherein a free edge of the flat tube engaging the slit is flush with a free edge of the collar.

* * * * *